US006058285A

United States Patent [19]

Takizawa et al.

[11] Patent Number: 6,058,285

[45] Date of Patent: May 2, 2000

[54] GLOSS AND IMAGE FORMING APPARATUS

[75] Inventors: Yoshio Takizawa, Fussa; Koji Takagi, Kawasaki; Norihiko Kaga, Kodaira, all of Japan

[73] Assignee: Bridgestone Corporation, Tokyo, Japan

[21] Appl. No.: 08/998,604

[22] Filed: Dec. 29, 1997

[30] Foreign Application Priority Data

Dec. 26, 1996 [JP] Japan ..... 8-357274
Mar. 25, 1997 [JP] Japan ..... 9-091659

[51] Int. Cl.[7] ..... G03G 15/08

[52] U.S. Cl. ..... 399/286

[58] Field of Search ..... 399/222, 265, 399/276, 279, 286, 239; 492/17, 18; 428/409

[56] References Cited

U.S. PATENT DOCUMENTS 5,187,849 2/1993 Kobayashi ..... 492/59
5,270,786 12/1993 Kikuchi et al. ..... 399/286
5,325,637 7/1994 Yasuda et al. ..... 451/38
5,565,968 10/1996 Sawa et al. ..... 355/259
5,655,197 8/1997 Okada et al. ..... 399/281
5,666,626 9/1997 Takizawa et al. ..... 399/286
5,697,027 12/1997 Takagi et al. ..... 399/279
5,858,593 1/1999 Tamura et al. ..... 430/106.6
5,903,808 5/1999 Takizawa et al. ..... 399/286

FOREIGN PATENT DOCUMENTS 4-278975 10/1992 Japan .

*Primary Examiner*—William Royer
*Assistant Examiner*—William A. Noē
*Attorney, Agent, or Firm*—Sughrue, Mion, Zinn, Macpeak & Seas, PLLC

[57] ABSTRACT

A toner-carrying roller such as a developing roller having a surface gloss of 2 or above, with the surface gloss of the black glass standard plate having a reflective index of 1.567 (according to DIN 67 530) being 100. The toner-carrying roller provides high-quality images free of density variation and fogging owing to its surface characteristics specified by the surface gloss. In addition, it keeps its good performance without deterioration in image quality for a long period of use.

10 Claims, 1 Drawing Sheet

GLOSS AND IMAGE FORMING APPARATUS

BACKGROUND OF THE INVENTION

1. Field of the Invention

The present invention relates to a toner-carrying roller such as a developing roller and an image forming apparatus provided therewith which are used in an electrophotographic apparatus and electrostatic recording apparatus (such as copiers and printers) to supply a toner to an image-forming body (such as photoconductive drum, belt, paper, OHP, and photographic paper), thereby forming thereon a visible image. More particularly, the present invention relates to a toner-carrying roller and an image forming apparatus provided therewith that provide high-quality images free of density fluctuation and fogging and maintain their performance without deteriorating images for a long period of time.

2. Description of the Prior Art

In electrophotographic apparatus and electrostatic recording apparatus (such as copiers and printers), the photoconductive drum (or any other body) supporting a latent image thereon is supplied with a toner which adheres to the latent image, thereby making it visible. This developing process is known as the pressure developing process. (U.S. Pat. Nos. 3,152,012 and 3,731,146) This process offers the advantage of requiring no magnetic material, which leads to a simpler, smaller apparatus. This process also permits a color toner to be used easily.

The pressure developing process is designed to carry out development in such a manner that the toner-carrying roller carrying a toner (usually a non-magnetic one-component developing agent) is brought into contact with the photoconductive drum (or any other body) supporting an electrostatic latent image so that the toner adheres to the latent image on the photoconductive drum. Therefore, it is necessary that the toner-carrying roller be formed from an electrically conductive elastic material.

As illustrated in FIG. 2, the pressure developing process employs a toner application roller 4 to supply a toner, a photoconductive drum 5 to hold an electrostatic latent image, and a toner-carrying roller 1 placed between them. As they turn in their respective directions indicated by arrows, the toner application roller 4 supplies the toner 6 to the surface of the toner-carrying roller 1. The thus supplied toner 6 is spread thin uniformly by the spreading blade 7. The toner-carrying roller 1 (carrying the toner 6 thereon) and the photoconductive drum 5 turn while keeping contact between them, so that the toner 6 (in the form of thin layer) adheres to the latent image on the photoconductive drum 5, making the latent image visible. In FIG. 2, the reference numeral 8 represents the image transfer unit which transfers the toner image to the recording medium (such as paper), and the reference numeral 9 represents the cleaning unit which, by means of the cleaning blade 10, removes residual toner remaining on the surface of the photoconductive drum 5 after image transfer.

For the above-mentioned process, it is necessary that the toner-carrying roller 1 and the photoconductive drum 5 rotate while keeping a close contact between them. To this end, the toner-carrying roller 1 is composed of a shaft 2 of good conducting material (such as metal) and an elastic, electrically conductive layer 3 made of elastic rubber (such as silicone rubber, NBR, and EPDM) or urethane foam incorporated with a conductive agent, as shown in FIG. 1.

There is another method for forming an image as disclosed in Japanese Patent Laid-open No. 116559/1983. This method employs a latent image holder and a developing sleeve which are arranged in close proximity to each other (without contact). The developing sleeve carries a non-magnetic toner in the form of thin layer, which jumps onto the latent image holder. In its modifications, the latent image holder takes the form of a belt instead of a drum. Further, a recording medium such as a sheet of plain paper, OHP, and photographic paper may be adopted, whereby a toner is supplied directly to the recording medium to form a visible image on the recording medium. For example, as in a mechanism disclosed in Japanese Patent Laid-open No. 129293/1996, a back electrode roller is provided on the back side of a recording medium, and a toner-carrying roller carrying a toner is provided on the front side of the recording medium in the vicinity thereof. The toner on the toner-carrying roller is controlled by an aperture electrode and jumped toward the back electrode roller, thereby supplying the toner to the recording medium present between the back electrode roller and the toner-carrying roller to form a visible image on the recording medium. These processes may also employ the same toner-carrying roller as mentioned above.

The conventional toner-carrying roller mentioned above, however, suffers the disadvantage of being liable to cause fogging, particularly in the case where a non-magnetic toner is used. To eliminate this disadvantage, it is necessary to carry the toner in the form of uniform thin layer, while keeping it evenly highly charged. This necessitates an ability to adequately control the surface properties of the roller. One way to achieve this object is attained by making the surface of the toner-carrying roller as smooth and even as possible or by attaching to the surface of the conductive layer 3 of the toner-carrying roller a resin which contributes to the electrification of the toner. In this way it is possible to improve the surface smoothness and charging performance. Nevertheless, the resulting toner-carrying roller does not necessarily give satisfactory performance because it is impossible to detect subtle changes on the roller surface and hence it is impossible to quantitatively control the characteristic properties of the roller surface. Thus the toner-carrying roller usually causes a problem with deterioration in image quality after a long period of use. There even is an instance where the above-mentioned means does not prevent poor images (with fogging and decreased density) from occurring from the beginning of operation and on.

SUMMARY OF THE INVENTION

The present invention was completed in view of the foregoing. It is an object of the present invention to provide a toner-carrying roller which permits its surface characteristics to be quantitatively controlled, yields high-quality images free of fogging and density decrease, and prevents deterioration in image quality after a long period of use. It is another object of the present invention to provide an image forming apparatus provided with the toner-carrying roller.

DESCRIPTION OF THE PREFERRED EMBODIMENTS

Figure 1:
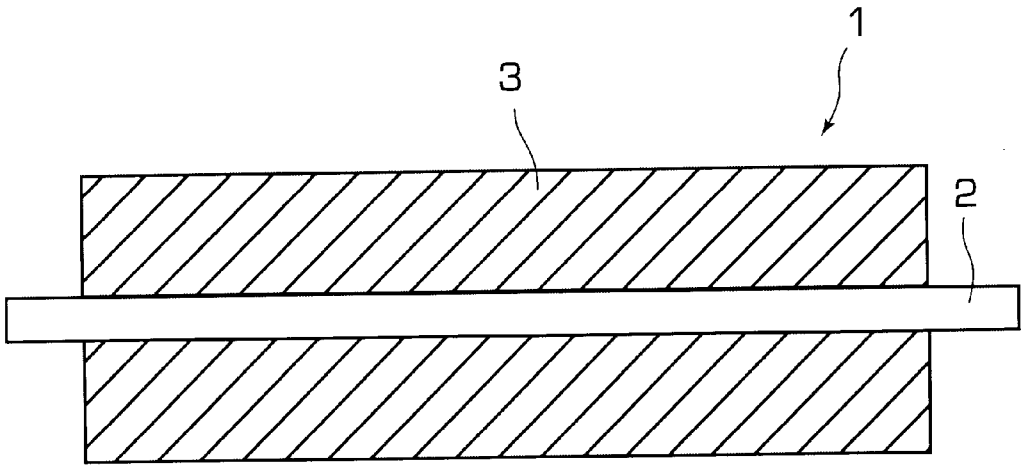
FIG. 1 is a schematic sectional view of one example of the toner-carrying roller pertaining to the present invention.

In order to achieve the above-mentioned object, the present inventors carried out a series of experiments which led to the finding that it is possible to obtain high-quality images free of fogging and density decrease and to prevent deterioration in image quality after a long period of use, by using a toner-carrying roller having a surface gloss of 2 or above, with the surface gloss of the black glass standard plate having a reflective index of 1.567 (according to DIN 67 530) being 100. The process consisted of causing a toner to be supported on the surface of the toner-carrying roller, thereby forming a thin layer of the toner, bringing (while keeping this state) the surface of the toner-carrying roller into contact or proximity with the image forming body (which is the latent image holder carrying an electrostatic image thereon), thereby supplying the toner to the surface of the image forming body and forming a visible image on the surface of the image forming body. The present invention is based on this finding.

The first aspect of the present invention resides in a toner-carrying roller to form a visible image on the surface of an image-forming body by causing a toner to be supported on the surface of the toner-carrying roller, thereby forming a thin layer of the toner, bringing (while keeping this state) the toner-carrying roller into contact or proximity with the image-forming body, thereby supplying the toner to the surface of the image-forming body and forming a visible image on the surface of the image-forming body, wherein said toner-carrying roller has a surface gloss of 2 or above, with the surface gloss of the black glass standard plate having a reflective index of 1.567 (according to DIN 67 530) being 100.

The second aspect of the present invention resides in an image forming apparatus of the type having a toner-carrying roller which, while carrying a toner on the peripheral surface thereof, comes into contact or proximity with the surface of an image-forming body and rotates, thereby transferring the toner to the surface of the image-forming body and forming a visible image on the surface of the image-forming body, wherein the toner-carrying roller is the one defined above in the first aspect of the present invention.

The invention will now be described in more detail. The toner-carrying roller pertaining to the present invention is characterized by having a surface gloss of 2 or above. It is usually composed of a shaft 2 of good conductive material and a conductive layer 3 formed thereon, like the roller shown in FIG. 1.

The above-mentioned shaft 2 may be formed from any material so long as it has good electrical conductivity. It is usually a cylindrical solid or hollow metal shaft.

On the shaft 2 is the electrically conductive layer 3, which is formed from an elastomer (such as polyurethane and EPDM), foam, or molded plastics incorporated with an electrically conductive powdery material (such as carbon black, metal powder, and metal oxide powder) or an ionized electrically conductive material (such as sodium perchlorate). The resistivity of the toner-carrying roller should preferably be in the range of $10^3$ to $10^{10}$ Ωcm, particularly $10^4$ to $10^8$ Ωcm.

The raw material for the conductive layer of the toner-carrying roller includes, for example, polyurethane, EPDM, natural rubber, butyl rubber, nitrile rubber, polyisoprene rubber, polybutadiene rubber, silicone rubber, styrene-butadiene rubber, ethylene-propylene rubber, chloroprene rubber, and acrylic rubber, and mixtures thereof Of these examples, polyurethane and EPDM are preferable. Additional examples of the raw material are such plastics as phenolic resin, polyester, and polycarbonate.

Polyurethane elastomer or foam as the raw material for the electrically conductive layer 3 may be prepared in any manner, such as incorporation of a polyurethane prepolymer with carbon black and subsequent crosslinking, or incorporation of a polyol with an electrically conductive material and subsequent reaction with a polyisocyanate by one-shot process.

Polyurethane is prepared from a hydroxyl compound and a polyisocyanate. The former includes polyols commonly used for the production of flexible polyurethane foam and urethane elastomer. Their examples are polyether polyol, polyester polyol, and polyether-polyester-polyol (a copolymer of the first two), all of which have terminal hydroxyl groups. Additional examples are polyolefin polyol (such as polybutadiene polyol and polyisoprene polyol) and so-called polymer polyol which is obtained by polymerization of an ethylenic unsaturated monomer in polyol. The polyisocyanate is one which is commonly used for the production of polyurethane foam and urethane elastomer. It includes, for example, tolylene diisocyanate (TDI), crude TDI, 4,4-diphenylmethane diisocyanate (MDI), crude MDI, aliphatic polyisocyanate having 2–18 carbons, alicyclic polyisocyanate having 4–15 carbons, and their mixture and modified product (such as prepolymer obtained by their partial reaction with polyol).

EPDM is a terpolymer composed of ethylene, propylene, and a third component. The third component is not specifically restricted; its preferred examples are dicyclopentadiene, ethylidene norbornene, and 1,4-hexadiene. The ratio of the three components are not specifically restricted. The content of ethylene and propylene should preferably be 5~95 wt %, and the content of the third component should preferably be such that the iodine value is 0–50. Incidentally, it is possible to use two or more kinds of EPDM differing in iodine value. EPDM may be blended with silicone rubber or silicone-modified EPDM or both. In this case, the amount of silicone-modified EPDM should be 5–80parts by weight for 100 parts by weight of EPDM. The silicone-modified EPDM is a hybrid rubber having the bond strength between EPDM and silicone increased by a silanol compound or siloxane.

The electrically conductive layer may be made rubbery by crosslinking with a crosslinking agent (such as organic peroxide or sulfur). Both crosslinking agents may be used in combination with a vulcanization auxiliary, vulcanization accelerator, accelerator activator, or vulcanization retarder. It may be incorporated further with additives, such as peptizing agent, blowing agent, plasticizer, softener, tackifier, anti-tack agent, mold releasing agent, extender, and coloring agent, which are commonly used as compounding ingredients.

In the case where the electrically conductive layer 3 is formed from polyurethane or EPDM, it is possible to incorporate it with a charge-controlling agent (such as nigrosine, triaminophenylmethane, and cation dye) or fine powder (of silicone resin, silicone rubber, or nylon) to control how much the toner is charged on its surface. The amount of the charge-controlling agent should preferably be 1–5 parts by weight and the amount of the fine powder should preferably be 1–10 parts by weight, both for 100 parts by weight of the polyurethane or EPDM.

The electrically conductive layer 3 is made conductive by incorporation with an electrically conductive material exemplified below.

Conductive carbon such as ketjen black EC and acetylene black.

Rubber black such as SAF, ISAF, HAF, FEF, GPF, SRF, FT, and MT.

Color (ink) carbon with oxidation treatment, thermally decomposed carbon, natural graphite, and artificial graphite.

Metal and metal oxide, such as antimony-doped tin oxide, titanium oxide, zinc oxide, nickel, copper, silver, and germanium.

Conductive polymer, such as polyaniline, poylpyrrole, and polyacetylene.

Of these examples, carbon black is desirable because it is inexpensive and it imparts a desired level of conductivity using a small amount. The conductive powder is used in an amount of 0.5–50 parts by weight, preferably 1–30 parts by weight, for 100 parts by weight of polyurethane.

Examples of the ionic conductive material (as the electrically conductive material) include such inorganic compounds as sodium perchlorate, lithium perchlorate, calcium perchlorate, and lithium chloride, and such organic compounds as dimethylammonium sulfate, stearylammonium acetate, laurylammonium acetate, octadecyltrimethylammonium perchlorate, and tetrabutylammonium borofluoride.

The conductive layer 3 may have an unrestricted resistance in the range of $10^3$ to $10^{10}$ Ωcm, preferably $10^4$ to $10^8$ Ωcm, which is attained by the adequate compounding of the above-mentioned electrically conductive material. With a resistance lower than specified above, the conductive layer would permit charge to leak to the photoconductive drum or destroy itself by the high voltage. With a resistance higher than specified above, the conductive layer tends to cause fogging.

The conductive layer 3 is not specifically restricted in hardness. In the case where the toner-carrying roller comes into contact with the photoconductive drum, it should have a hardness lower than 60, preferably 20–60, more preferably 25–55, in terms of JIS A scale. With a hardness higher than 60, the conductive layer forms only a small contact area between it and the photoconductive drum, resulting in unsatisfactory development. With an excessively low hardness, the conductive layer suffers a great permanent set, resulting in an uneven image density when the toner-carrying roller is deformed or becomes eccentric. The permissible lowest hardness is such that the permanent set is lower than 20%.

The surface roughness of the conductive layer 3 (or the surface roughness of the toner-carrying roller of the present invention) is not specifically restricted. It should preferably be lower than 15 μm Rz, particularly 1–15 μm Rz, more preferably 1–10 μm Rz, as measured on JIS ten point mean surface roughness Rz scale. With a surface roughness greater than specified above, the conductive layer will not form the toner layer with uniform thickness and with uniform charge.

The surface of the conductive layer 3 may be coated with a resin other than the resin constituting the conductive layer 3. This resin is not specifically restricted so long as it does not stain the latent image holder (such as photoconductive drum). It includes, for example, urea resin, melamine resin, alkyd resin, phenol-modified alkyd resin, silicone-modified alkyd resin, oil-free alkyd resin, acrylic resin, silicone resin, fluoroplastics, phenolic resin, polyamide resin, epoxy resin, polyester resin, maleic acid resin, and urethane resin. Of these examples, urea resin, melamine resin, silicone resin, phenolic resin, alkyd resin, modified alkyd resin, oil-free alkyd resin, and acrylic resin are preferable because of their good film-forming properties and good adhesion.

The above-mentioned resin may be made electrically conductive by incorporation with an electrically conductive material according to need. This electrically conductive material may be the same one as used for the conductive layer 3 mentioned above. The selection of the electrically conductive material depends on the intended use of the toner-carrying roller. In general, the conductive layer 3 permits the toner to be charged satisfactorily when its surface part contains no conductive powder such as carbon. However, in the case where the toner-carrying roller is used for a high-speed printer, it is desirable that the surface part of the conductive layer 3 contain a conductive powder so as to effectively prevent fogging due to low voltage.

The conductive layer 3 may be given the above-mentioned resin by surface coating 14 with its solution. Surface coating may be accomplished by dipping, spraying, or roll coating. Dipping will take 5 seconds to 5 minutes, preferably 10 seconds to 1 minute, at room temperature. Spraying may employ a solution whose concentration (10–30%) is higher than that of the solution for dipping. Solvents for the resin solution are not specifically restricted. Their preferred examples include lower alcohols (such as methanol, ethanol, and isopropanol), ketones (such as acetone, methyl ethyl ketone, and cyclohexanone), and toluene and xylene.

The surface coating 14 with a resin reduces the friction of the roller surface to some extent. For a lower friction, the resin may be incorporated with a variety of additives, such as silicone resin, silicone resin powder, fluorine-based or silicone-based surface active agent, silicone coupling agent, and silica powder, which do not stain the photoconductive body and have no adverse effect on the uniform surface treatment.

The silicone resin includes, for example, methyl silicone, methylphenyl silicone, modified products thereof, and silicone-epoxy block copolymer, which are soluble in solvents.

The silicone resin powder includes, for example, methyl silicone polymer, methylphenyl silicone polymer, and amino-modified silicone polymer, which are in the form of fine powder having an average particle diameter of 0.1–100 μm (spherical or irregular).

The fluorine-based surface active agent includes, for example, ionic ones formed by bonding between fluorinated alkyl and carboxylic acid or between carboxylate and sulfonate, and nonionic ones formed by bonding between fluorinated alkyl and alcohol or ether. It also includes polymers and copolymers containing fluorinated alkyl in the main or side chains.

The silicone-based surface active agent includes, for example, siloxane-oxyethylene copolymer (which is composed of methyl silicone and hydrophilic or hydrophobic segments) and a copolymer composed of methyl silicone and acrylic segments.

The silicone-coupling agent includes, for example, ordinary silane coupling agents and special silanes having terminal amino groups, isocyanate groups, or vinyl groups.

These additives may be used alone or in combination with one another. (Incidentally, fluoroplastics also reduce friction.) They should be used in an amount of 1–100 parts by weight, preferably 10–75 parts by weight, for 100 parts by weight of the resin component. In the case where an ionic conductive substance is used as the electrically conductive material, the amount of the additives should preferably be 0.001–1 part by weight for 100 parts by weight of the resin component. In the case where a conductive powder (such as carbon) is used as the electrically conductive material, the amount of the additives should preferably be 1–50 parts by weight for 100 parts by weight of the resin component.

The resin component to be added onto the conductive layer 3 may be in the form of film 14 (which entirely covers the surface of the conductive layer 3) or in the form of discrete particles, also denoted by numeral 14, (which are embedded in the surface of the conductive layer 3). In the latter case, the surface of the conductive layer 3 may have minute projections left uncovered by the resin component.

According to the present invention, the toner-carrying roller is characterized by its surface gloss of 2 or above (preferably 4 or above), with the surface gloss of the black glass standard plate having a reflective index of 1.567 (according to DIN 67 530) being 100. The surface characteristics of the roller can be completely controlled in this manner, to obtain high-quality images free of fogging, while preventing deterioration in image quality after a long period of use.

The toner-carrying roller is not specifically restricted in structure (as shown in FIG. 1) so long as it has the surface gloss of 2 or above. It may be in the form of hollow cylinder (sleeve); however, it is desirable that it consist of a shaft 2 and a conductive layer 3 formed thereon as shown in FIG. 1. In this case, the surface gloss should preferably be 2–50, particularly 4–30, although it is not specifically restricted. In the case where the conductive layer 3 is coated with a resin component (as mentioned above), the surface gloss should preferably be 10–120, particularly 20–100, although it is not specifically restricted.

The surface gloss is expressed in terms of index, with the surface gloss of the black glass standard plate having a reflective index of 1.567 (according to DIN 67 530) being 100. This surface gloss can be easily measured (directly without conversion) by using a haze-gloss meter made by Big-Gardner.

Figure 2:
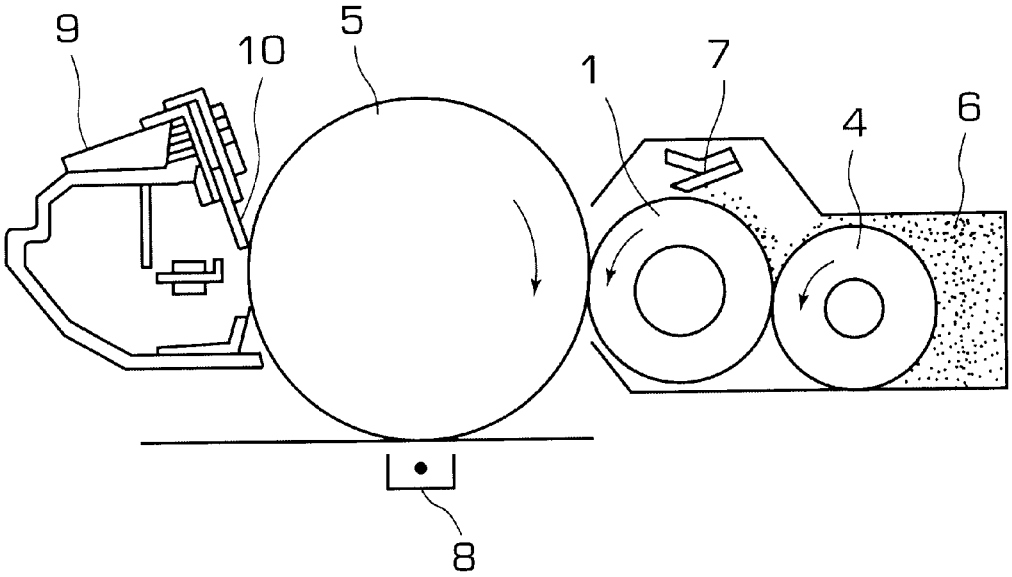
FIG. 2 is a schematic sectional view of one example of the image forming apparatus pertaining to the present invention.

The toner-carrying roller of the present invention can be built into the ordinary image forming apparatus such as developing unit that employs a one-component toner. As illustrated in FIG. 2, the toner-carrying roller (developing roller) 1 of the present invention is placed between the toner application roller 4 to supply a toner and the photoconductive drum 5 to hold an electrostatic latent image. The toner-carrying roller 1 is in contact or proximity with the photoconductive drum 5. As they turn, the toner application roller 4 supplies the toner 6 to the toner-carrying roller 1. The thus supplied toner 6 is spread thin uniformly by the spreading blade 7 and the spread toner is transferred to photoconductive drum 5 so that the electrostatic latent image on the photoconductive drum 5 is made visible. A detailed description about FIG. 2 is omitted here because it has been given in the section of prior art.

In this case, the toner-carrying roller of the present invention is suitably used to make visible with a one-component toner the electrostatic latent image held on the surface of the photoconductive drum 5. It may also be used for any image-forming body in the form of belt, for instance, rather than a drum, so long as the image-forming body is designed to make latent images visible with the toner supplied by the toner-carrying roller of the present invention. The toner-carrying roller of the present invention can also be used when a toner is supplied to a recording medium in the form of a sheet. For example, Japanese Patent Laid-open No. 129293/1996 discloses a mechanism comprising a back electrode roller disposed on the back surface side of a sheet (e.g., a sheet of plain paper, OHP or photographic paper) and a toner-carrying roller carrying a toner disposed in proximity to the front surface of the sheet, wherein the toner on the toner-carrying roller is jumped toward the electrode roller under the control of an aperture electrode, thereby supplying the toner to the sheet disposed between the electrode roller and the toner-carrying roller to form a visible image on the sheet. The toner-carrying roller of the present invention can also be used in this mechanism, while preventing deterioration in image quality and reproducing high-quality images even after a long period of use.

The above-mentioned toner should preferably be of non-magnetic one-component type, although the one of magnetic type can be used. The toner-carrying roller and image forming apparatus of the present invention may be suitably used for printing of black-and-white images with a magnetic one-component toner.

EXAMPLES

The invention will be described in more detail with reference to the following Examples and Comparative Examples, which are not intended to restrict the scope of the invention. Incidentally, in the following examples, surface coating was carried out by dipping in a treating solution for 30 seconds at room temperature.

Example 1

A polyol composition was prepared from the following components. (Parts means parts by weight.)

- 100 parts of polyether polyol produced by adding propylene oxide and ethylene oxide to glycerin, having a molecular weight of 5000 and a hydroxyl value of 33 ("Excenol 828" from Asahi Glass Co., Ltd.)
- 25.0 parts of urethane-modified MDI, containing 23% NCO ("Sumidule PF" from Sumitomo Bayer Urethane)
- 2.5 parts of 1,4-butanediol
- 0.01 part of dibutyltin dilaurate
- 2.0 parts of acetylene black The first four components were preliminarily mixed and then mixed by using a paint roll. Into the mixture was uniformly dispersed the last component. The polyol composition was poured into a mold which had been heated to 110° C. and then cured for 2 hours. Thus there was obtained a roller similar to the one shown in FIG. 1 which is composed of a metal shaft and an electrically conductive layer formed thereon. The surface of the roller was polished in dry process to give the desired toner-carrying roller.

- Polishing machine: traverse-type cylindrical polishing machine
- Speed of grinding wheel: 1500 rpm
- Speed of work: 100 rpm
- Traversing rate: 180 mm/min
- Grinding wheel: porous-type wheel having a grain size of 80–150 (made by Teiken Co., Ltd.)

Example 2

A toner-carrying roller was prepared by repeating the procedure of Example 1 except that the grinding machine was run at a traversing rate of 100 mm/min.

Example 3

For the purpose of surface coating, the toner-carrying roller prepared in Example 1 was dipped in a solution of methyl ethyl ketone containing 7.5 wt % each of alkyd resin and melamine resin. Dipping was followed by heat-drying.

Example 4

A toner-carrying roller was prepared by repeating the procedure of Example 3 except that the concentration of alkyd resin and melamine resin was changed to 3 wt %.

Example 5

A toner-carrying roller was prepared by repeating the procedure of Example 3 except that the concentration of alkyd resin and melamine resin was changed to 10 wt %.

Example 6

A toner-carrying roller was prepared by repeating the procedure of Example 1 except that the content of acetylene black in the polyol composition was changed to 3.0 parts. This toner-carrying roller underwent surface coating in the same manner as in Example 3 except that the concentration of alkyd resin and melamine resin was changed to 20 wt %.

Comparative Example 1

The same procedure as in Example 1 was repeated except that the traversing rate of the polishing machine was changed to 1000 mm/min.

Samples of the toner-carrying rollers obtained in Examples and Comparative Example mentioned above were tested for characteristic properties as follows. The results are shown in Table 1.

(1) Roller Resistance

Resistance was measured (using an ohmmeter R8340A made by Advantest) by applying a voltage of 100 V to the roller which was pressed against a copper plate under a load of 500 g each applied to both ends of the roller.

(2) Surface Roughness

Surface roughness was measured using a surface roughness meter ("Handysurf E-30A" made by Tokyo Seimitsu).

(3) Surface Gloss

A sample of the roller is cut to a length of 10 cm. The cut piece is fixed to a black holder suiting its diameter. A haze-gloss meter (made by Big-Gardner) is placed such that surface of the roller appears in the window of the meter. The sample is measured for surface gloss at an incident angle of 85° (with the measuring area being 8×60 mm). The measured value is an index, with the surface gloss of the black glass standard plate having a reflective index of 1.567 (according to DIN 67 530) being 100.

(4) Amount of charge on toner and amount of toner transferred

The toner-carrying roller is mounted on the image forming apparatus as shown in FIG. 2. It is turned at a peripheral speed of 50 mm/sec so that a uniform thin layer of toner is formed thereon. The toner within a prescribed area is sucked into a Faraday cage, and the amount of charge on the toner and the amount of the toner are measured.

(5) Image Forming

The toner-carrying roller is mounted on the image forming apparatus as shown in FIG. 2. Reversal development is carried out using a non-magnetic one-component toner having an average particle diameter of 7 μm, with the toner-carrying roller turning at a peripheral linear speed of 60 mm/sec. An image obtained in the initial stage and an image obtained after 1000 printings are tested for sharpness, density uniformity, fogging, and toner scattering.

TABLE 1

| | Roller resistance (Ω) | Surface roughness (μm) | Surface gloss | Amount of charge on toner (μc/g) | Amount of toner transferred (mg/cm²) | Image quality |
|---|---|---|---|---|---|---|
| Example 1 | $2 \times 10^7$ | 9 | 3.5 | −18.5 | 0.85 | good |
| | | | | −16.5 | 0.80 | slight fogging |
| Example 2 | $2 \times 10^7$ | 5 | 4.2 | −20.5 | 0.70 | good |
| | | | | −18.0 | 0.65 | slight fogging |
| Example 3 | $8 \times 10^7$ | 7 | 20.1 | −25.5 | 0.65 | good |
| | | | | −23.5 | 0.55 | good |
| Example 4 | $5 \times 10^7$ | 8 | 6.2 | −20.0 | 0.75 | good |
| | | | | −15.5 | 0.85 | fogging, decreased density |
| Example 5 | $4 \times 10^6$ | 5 | 35.5 | −28.5 | 0.55 | good |
| | | | | −26.0 | 0.50 | good |
| Example 6 | $8 \times 10^6$ | 3 | 82.5 | −38.5 | 0.45 | good |
| | | | | −32.5 | 0.40 | good |
| Comparative Example 1 | $2 \times 10^7$ | 13 | 1.5 | −10.5 | 1.2 | fogging, thick letters |
| | | | | −7.0 | 1.1 | severe fogging, decreased density |

Results of measurement and observation in the initial stage are given in the upper row.
Results of measurement and observation after 1000 times of printing are given in the lower row.

It is apparent from Table 1 that the toner-carrying roller pertaining to the present invention provides high-quality images free of density variation and fogging owing to its surface characteristics specified by the surface gloss. In addition, the toner-carrying roller keeps its good performance for a long period of use and gives images of good quality even after 1000 times of printing.

We claim:

1. A developing roller for making a latent image held on a photoconductive drum visible by causing a thin layer of non-magnetic one-component toner to be supported on the surface of the developing roller, such that bringing the developing roller into contact with the photoconductive drum applies toner to the surface of the photoconductive drum, making the latent image visible, said roller comprising a shaft having good electrical conductivity and an electrically conductive layer formed on the shaft, the conductive layer made from an elastomer, foam or molded plastics, wherein said conductive layer is coated with a resin made from a material that is different from that constituting the conductive layer, and said developing roller has a surface gloss of 20.1 to 82.5 according to DIN 67 530.

2. The developing roller as defined in claim 1 wherein the conductive layer has a resistivity of $10^3$ to $10^{10}$ Ω.cm.

3. The developing roller as defined in claim 1 wherein the conductive layer has a hardness of 20 to 60° as measured on JIS A scale.

4. The developing roller as defined in claim 1 wherein said conductor layer has a surface roughness of 1 to 15 μm Rz as measured on JIS ten point mean surface roughness Rz scale.

5. The developing roller as defined in claim 1 wherein the resin is one or more kinds selected from urea resin, melamine resin, silicone resin, phenolic resin, alkyd resin, modified alkyd resin, oil-free alkyd resin, and acrylic resin.

6. A developing apparatus of the type having a developing roller which, while carrying a non-magnetic one-component toner on the peripheral surface thereof, comes into contact with the surface of a latent image holder supporting an electrostatic latent image and rotates, thereby transferring the toner to the surface of the latent image holder and making said electrostatic latent image visible, wherein the developing roller comprises:

a shaft having good electrical conductivity and an electrically conductive layer formed thereon, said conductive layer made from an elastomer, foam or molded plastics and wherein said conductive layer is coated with a resin made from a material that is different from that constituting the conductive layer, and said developing roller has a surface gloss of 20.1 to 82.5 according to DIN 67 530.

7. The developing apparatus as defined in claim 6, wherein the conductive layer has a resistivity of $10^3$ to $10^{10}$ Ω.cm.

8. The developing apparatus as defined in claim 6, wherein the conductive layer has a hardness of 20 to 60° as measured on JIS A scale.

9. The developing apparatus as defined in claim 6, wherein said conductive layer has a surface roughness of 1 to 15 μm Rz as measured on JIS ten point mean surface roughness Rz scale.

10. The developing apparatus as defined in claim 6, wherein the resin is one or more kinds selected from urea resin, melamine resin, silicone resin, phenolic resin, alkyd resin, modified alkyd resin, oil-free alkyd resin, and acrylic resin.

* * * * *